US008348476B2

(12) United States Patent
Fletcher et al.

(10) Patent No.: US 8,348,476 B2
(45) Date of Patent: Jan. 8, 2013

(54) METHOD AND APPARATUS FOR A LIGHTING MODULE

(75) Inventors: Robert Kenneth Yasuji Fletcher, Racine, WI (US); Jeffrey L. Spenner, Milwaukee, WI (US)

(73) Assignee: Phoenix Products Company, Inc., Milwaukee, WI (US)

( * ) Notice: Subject to any disclaimer, the term of this patent is extended or adjusted under 35 U.S.C. 154(b) by 209 days.

(21) Appl. No.: 13/016,654

(22) Filed: Jan. 28, 2011

(65) Prior Publication Data

US 2012/0195041 A1 Aug. 2, 2012

(51) Int. Cl.
*F21S 13/10* (2006.01)
*F21V 3/00* (2006.01)

(52) U.S. Cl. ..... 362/363; 362/249.02; 362/311.02; 362/375; 362/800

(58) Field of Classification Search ..... 362/249.02, 362/311.02, 363, 374–375, 457, 545, 800
See application file for complete search history.

(56) References Cited

U.S. PATENT DOCUMENTS

| | | | |
|---|---|---|---|
| 613,647 | A | 11/1898 | Brown |
| 3,331,013 | A | 7/1967 | Cunningham |
| D275,948 | S | 10/1984 | Vakil |
| D304,030 | S | 10/1989 | Vakil |
| 5,731,663 | A | 3/1998 | Davis |
| D397,811 | S | 9/1998 | Vakil |
| D398,902 | S | 9/1998 | Spadafore |
| D415,104 | S | 10/1999 | Klaus et al. |
| D418,813 | S | 1/2000 | Smith |
| D425,024 | S | 5/2000 | Klaus et al. |
| 7,303,301 | B2 | 12/2007 | Koren et al. |
| D570,034 | S | 5/2008 | Westerheide |
| D627,727 | S | 11/2010 | Alexander et al. |
| 2009/0034283 | A1 | 2/2009 | Albright et al. |
| 2009/0237891 | A1 | 9/2009 | Liu et al. |

OTHER PUBLICATIONS

Non-Final Office Action mailed May 13, 2011 for U.S. Appl. No. 29/384,292, filed Jan. 28, 2011.
U.S. Appl. No. 29/384,292, filed Jan. 28, 2011.
U.S. Appl. No. 29/384,299, filed Jan. 28, 2011.
Notice of Allowance mailed May 20, 2011 for U.S. Appl. No. 29/384,299.

*Primary Examiner* — Jason Moon Han
(74) *Attorney, Agent, or Firm* — Whyte Hirschboeck Dudek S.C.; James A. Joyce

(57) ABSTRACT

A light source module that includes a light source and a housing, the housing having a top portion for receiving the light source and an upper portion extending from the top portion to form a recess. A first sealing material provided inside the recess to form a seal that at least partially encapsulates the light source.

19 Claims, 5 Drawing Sheets

METHOD AND APPARATUS FOR A LIGHTING MODULE

FIELD OF THE INVENTION

The present invention relates generally to lighting fixtures and components.

BACKGROUND OF THE INVENTION

The lighting industry utilizes a substantial number of lighting fixture types designed for specific locations and uses. Certain locations require the benefit of a lighting fixture style known as a "vapor proof" fixture. These fixtures generally utilize a glass or plastic globe and a non-integrated/distinct seal to seal the lamp and some of the electrical components from environmental elements that can damage or otherwise degrade the lamp and electrical components. In this manner, the fixture can be readily used in problematic environments, such as those including water, explosive gases, a high level of particulates, etc. (commonly found in industrial, mining, oil and marine applications). Further, these fixtures commonly utilize an A-lamp, High Intensity Discharge (HID) lamp, or fluorescent lamp, which can have a relatively short life span and are relatively inefficient light sources. Additionally, the globe is susceptible to being easily broken by accident or vandalism, thereby exposing the lamp and electrical components to the environment, which may significantly shorten the lifespan of the fixture. Also, these lamps are fragile and once the globe is broken, they can be easily damaged, rending the fixture completely inoperable.

BRIEF SUMMARY OF THE INVENTION

In at least some embodiments, the device and method for a lighting module relates to a light source module that includes a light source, a housing having a top portion for receiving the light source and an upper portion extending from the top portion to form a recess, and a first sealing material provided inside the recess to form a seal that at least partially encapsulates the light source. The light source can further include at least one light emitting diode (LED).

In at least some other embodiments, the device and method for a lighting module relates to a light fixture having a light source module that includes a housing with a top portion for receiving a solid-state light source and an upper portion extending from the top portion to form a recess, and a first sealing material provided inside the recess to form a seal that at least partially encapsulates the light source. Further included are a mounting base secured to the light source module and having a bottom portion that is configured for mounting to a surface, and a globe positionable over the top portion and securable to the upper portion of the housing, the globe having a rim portion that is configured to abut the seal along the perimeter of the rim portion to substantially prevent the intrusion of external environmental elements into an interior space of the globe.

In at least some additional embodiments, the device and method for a lighting module relates to a method that includes providing a housing section, providing a light source, and encapsulating the light source at least partially inside the housing section with a first sealing material to form a seal that substantially prevents exposing the light source to environmental elements.

Other embodiments, aspects, features, objectives and advantages of the present invention will be understood and appreciated upon a full reading of the detailed description and the claims that follow.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. The drawings illustrate a best mode presently contemplated for carrying out the invention. Like reference numerals are used to indicate like components. In the drawings.

DETAILED DESCRIPTION OF THE PREFERRED EMBODIMENT

Figure 1:
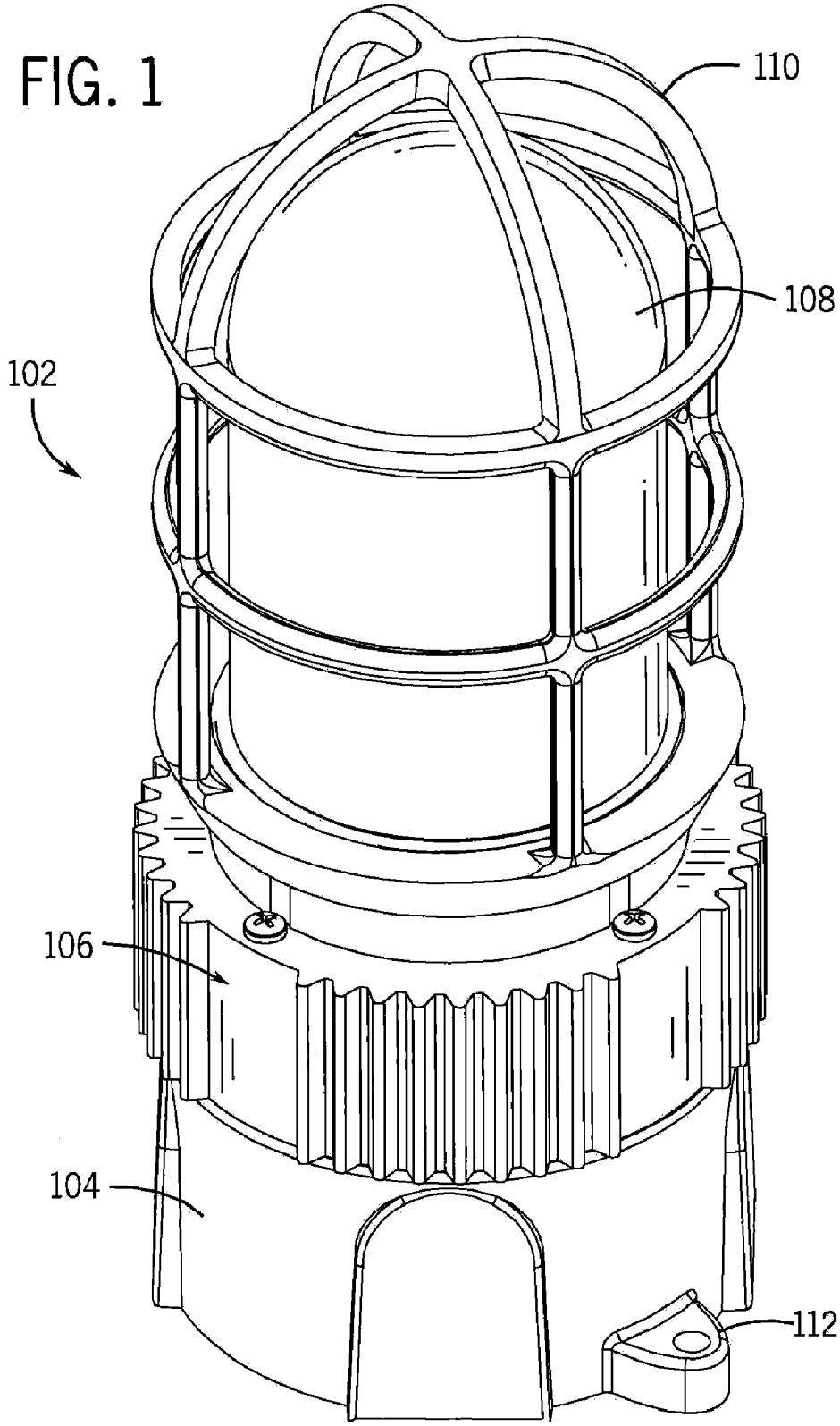
FIG. 1 is a perspective view of an exemplary light fixture.
Figure 2:
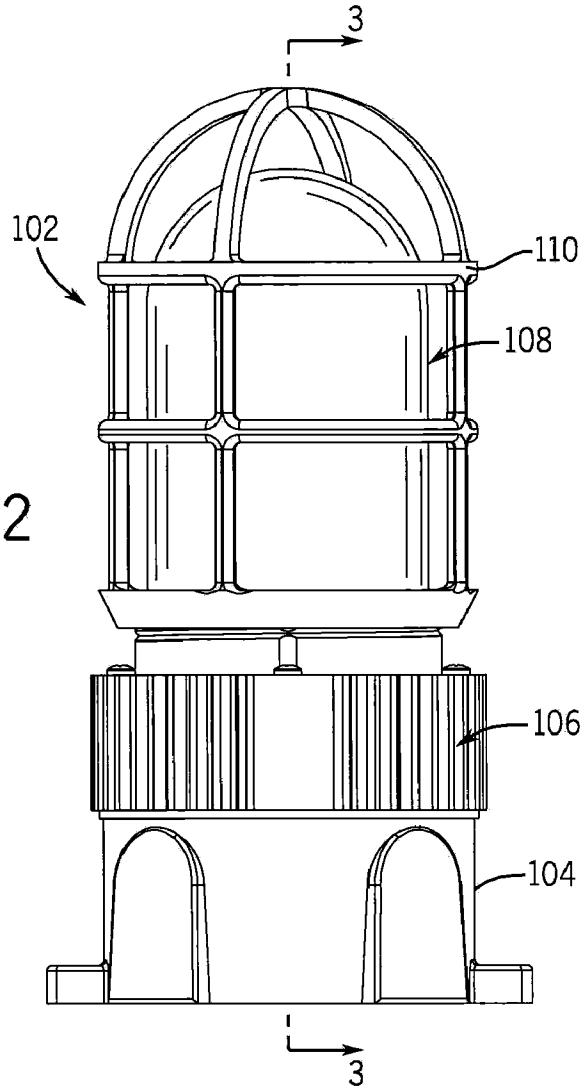
FIG. 2 is a side view of the light fixture FIG. 1.

Referring to FIGS. 1 and 2, an exemplary light fixture 102 is provided that includes a mounting base 104, a light source module 106, a globe 108, and a guard 110. In at least some embodiments, the mounting base 104 includes one or more fastening portions 112, such as tabs integrally formed with or otherwise secured to the mounting base 104. The fastening portions 112 facilitate securing of the mounting base 104 to a surface, such as a wall or ceiling. The mounting base 104 can serve as a junction box/wiring compartment for the wiring that powers the light fixture 102.

Figure 3:
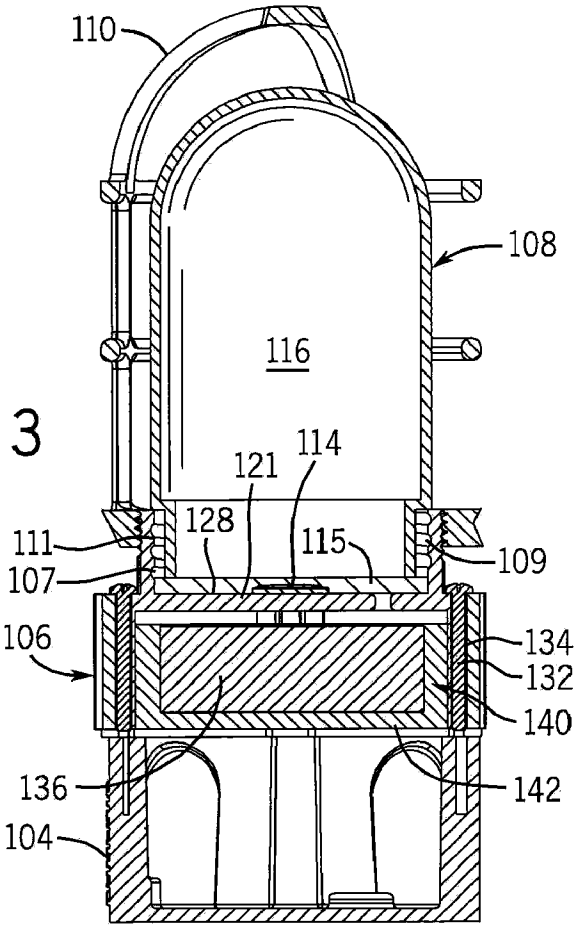
FIG. 3 is a cross-sectional view of the light fixture FIG. 2 at line 3-3.

Referring to FIG. 3, as discussed in further detail below, the light source module 106 is secured to the mounting base 104 and includes a light source 114 for providing illumination. The globe 108 is securable to the light source module 106 and can serve many functions, such as protecting the light source 114, controlling the light emitted, and coloring the light emitted from the light source 114. The globe 108 is securable to the light source module 106 using a threaded connection via the globe threads 109 and interior threads 111, although other securing methods can be used, such as a flange securing method. A seal 115 is provided between a rim portion 107 of the globe 108 and the light source module 106, to prevent or substantially prevent the intrusion of environmental elements, such as water, particulates, vapors, etc., into an interior space 116 of the globe 108. The guard 110 can be provided to at least partially surround the globe 108 and can serve to protect it from breakage by a physical strike.

Figure 4:
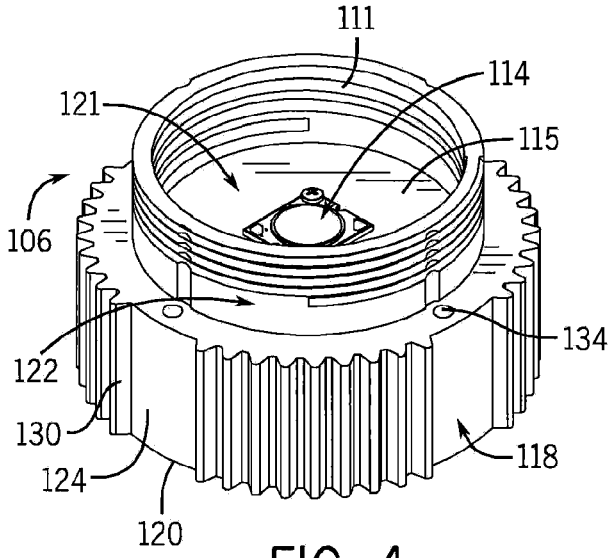
FIG. 4 is a perspective view of an exemplary light source module.
Figure 5:
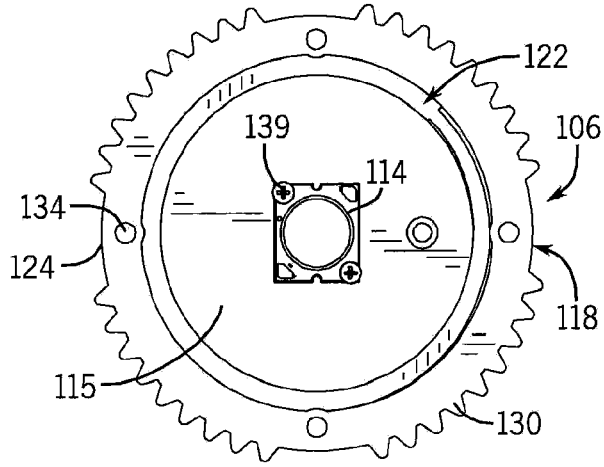
FIG. 5 is a top view of the light source module of FIG. 4.
Figure 6:
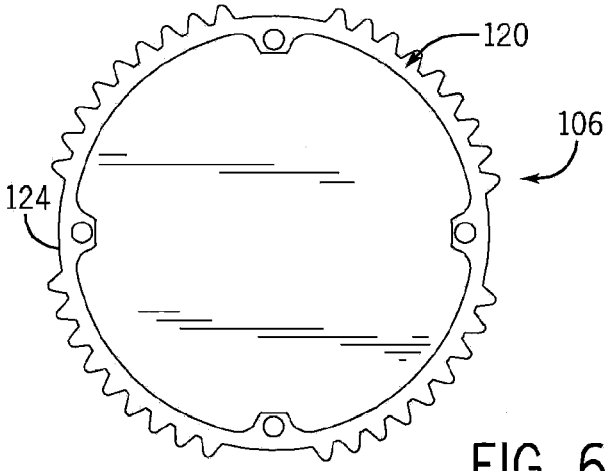
FIG. 6 is a bottom view of the light source module of FIG. 4.
Figure 7:
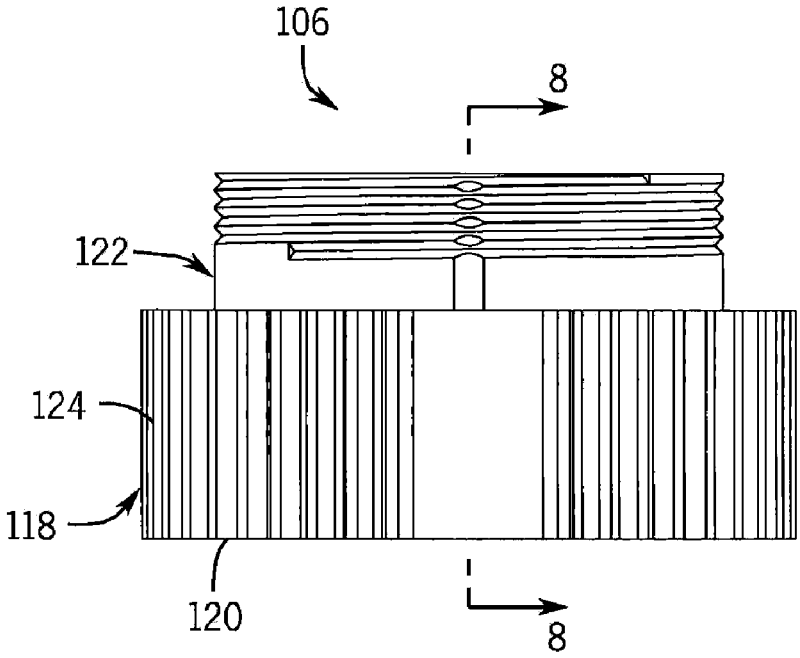
FIG. 7 is a side view of the light source module of FIG. 4.

Referring to FIGS. 4-8, the exemplary light source module 106 is depicted in various views. As seen in FIG. 4, in at least some embodiments the light source module 106 includes a housing 118 having a bottom portion 120, a top portion 121, a cylindrical upper portion 122, and a side portion 124. The upper portion 122 includes interior threads 111 for securing the globe 108 at least partially inside the upper portion 122, and exterior threads 126 for securing the guard 110 at least partially outside the top portion 121. The light source module 106 further includes a light source 114. The light source 114 is positioned about a top surface 128 (FIG. 8) of the top portion 121 of the housing 118. The side portion 124 includes protrusions 130 that in at least some embodiments, can serve as heat-sink portions to transfer heat from the light source module 106 to the surrounding environment. In addition, the protrusions 130 can extend along the side portion 124 in various manners, such as vertical extensions, horizontal extensions, etc. Further, the protrusions 130 can radiate inwards, outwards, or both, relative to the side portion 124. In at least some embodiments, no protrusions 130 are provided.

The light source module 106 can be secured to the mounting base 104 using one or more fastening methods. For example, in at least some embodiments, threaded screws 132 (FIG. 3) can be provided to pass through screw passages 134 situated in the light source module 106 and screw into the mounting base 104 for securing the light source module 106 to the mounting base 104. In this manner, the light source module 106 can be installed as a part of the light fixture 102 during manufacturing or can be installed as a retrofit for an existing light fixture that is similar or dissimilar to light fixture 102. When installed in a retrofit application, the light source module 106 can serve as a replacement for an existing light source module.

As seen in FIG. 3, the light source 114 is positioned about the top surface 128 of the top portion 121 of the housing 118 to project light into the interior space 116 of the globe 108. In at least some embodiments, the light source 114 is a solid-state device, such as a semiconductor-based light source, for example a Light Emitting Diode (LED). In at least some embodiments, the light source 114 is a multiple chip array LED that includes a driver circuit 136 for powering the LED. Other types of solid-state lighting sources currently known and later developed can also be provided in place of or in addition to the light source 114, as well as other types of driver circuits 136 currently known and later developed. The semiconductor-based light source 114 provides a high efficiency reliable light source with a long life cycle and, particularly when used as a retrofit application, allows for a renewal of existing light fixtures without the significant expense of replacing the entire fixtures. Further, retrofitting existing fixtures with semiconductor-based light source modules can allow for an existing installation of light fixtures to be upgraded to meet Federal and/or State energy code compliance requirements.

The light source 114 can be positioned about the top surface 128 in one of numerous methods, such as securing it to the top surface 128 by one or more fasteners 139 (FIG. 5) and/or securing in position using the seal 115. In at least some embodiments, the driver circuit 136 is situated inside a base chamber 140 (FIGS. 3 and 8) beneath the top surface 128. Electrical wiring/connections (not shown) that connect the light source 114 with the driver circuit 136 can extend through an aperture 138 (FIG. 8) formed in the top surface 128.

Figure 8:
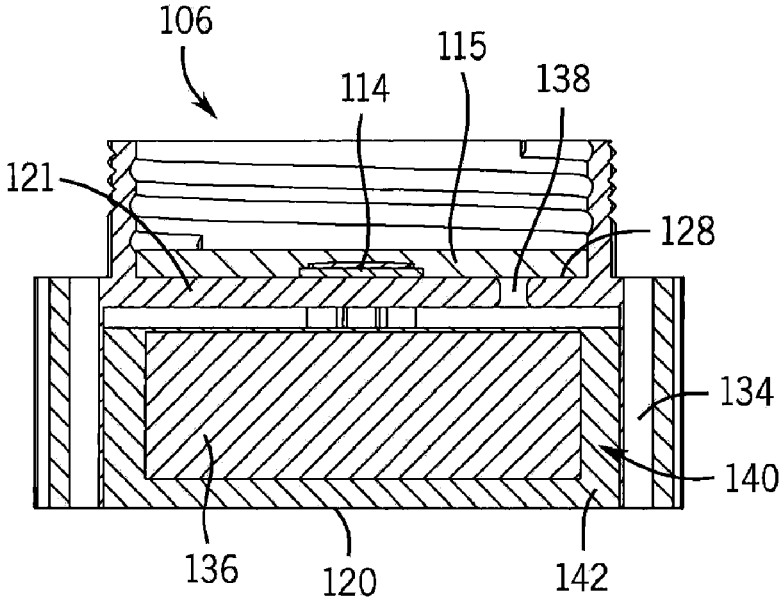
FIG. 8 is a cross-sectional view of the light source module of FIG. 7 at line 8.

Still referring to FIG. 8, after the driver circuit 136 is positioned inside the base chamber 140, the base chamber 140 can be sealed with a base sealant 142, such as a fluidic sealant, for example epoxy. The base sealant 142 cures to a semi-solid or solid state, which at least partially encapsulates the driver circuit 136 and serves to immobilize and protect it, as well as the electrical wiring/connections (not shown), from moisture intrusion, harsh shock and vibration, etc. In addition, the base sealant 142 can serve to dissipate heat generated by the LED circuit driver 136. During sealing, the electrical wiring from the driver circuit 136 is allowed to protrude from the bottom portion 120 and therefore is available for connection to power source wiring inside the mounting base 104.

In at least some embodiments, after installation of one or more of the light source 114, the driver circuit 136, and the interconnecting electrical wiring/connections, a source sealant is provided to form the seal 115 that at least partially encapsulates the light source 114. The top portion 121 and the upper portion 122 together form a recess, which provides a mold for the source sealant to be applied to form the seal 115. The source sealant that forms the seal 115 can cure to at least one of a solid and semi-solid, and as such, can remain flexible. In at least some embodiments, the source sealant is an optically clear silicone material, although other materials and levels of transparency can be utilized, such as a translucent and/or colored material. Once the source sealant has cured to form the seal 115, the seal 115 acts as a coating to immobilize the light source 114 and the electrical wiring/connections and to protect them from various environmental elements, such as dust, moisture, mildew, mold, etc. In this regard, the seal 115 allows for the globe 108 to be broken while maintaining protection of the light source 114 and the electrical wiring/connections from the environment, resulting in a longer life cycle and greater reliability of the light source module 106 and associated light fixture 102.

In addition, the seal 115 serves as an insulating component to protect the light source 114 and the electrical wiring/connections from damage due to harsh shock and vibration. This allows for the light fixture 102 to be used in more demanding environments, such as a mine, where traditional lamps could have a substantially limited life cycle.

Additionally, the seal 115 is, in at least one embodiment, flexible when cured to provide a mating seal between the rim portion 107 of the globe 108 and the top portion 121 of the light source module 106. In this regard, a separate, non-integrated/distinct seal that is required in a typical vapor proof fixture is not necessary, thereby eliminating a distinct component. Further, in at least one embodiment seal 115 does not have to at least partially encapsulate the light source 114 to serve as a seal between the rim portion 107 and top portion 121.

Figure 10:
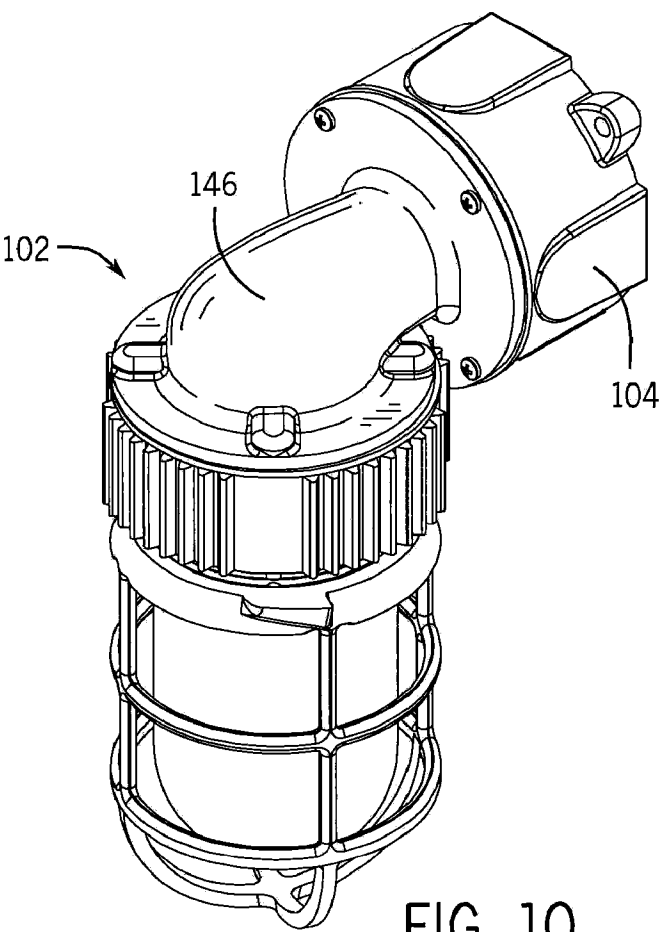
FIG. 10 is a perspective view of an exemplary light fixture utilizing the light source module and a wall mount extension.
Figure 9:
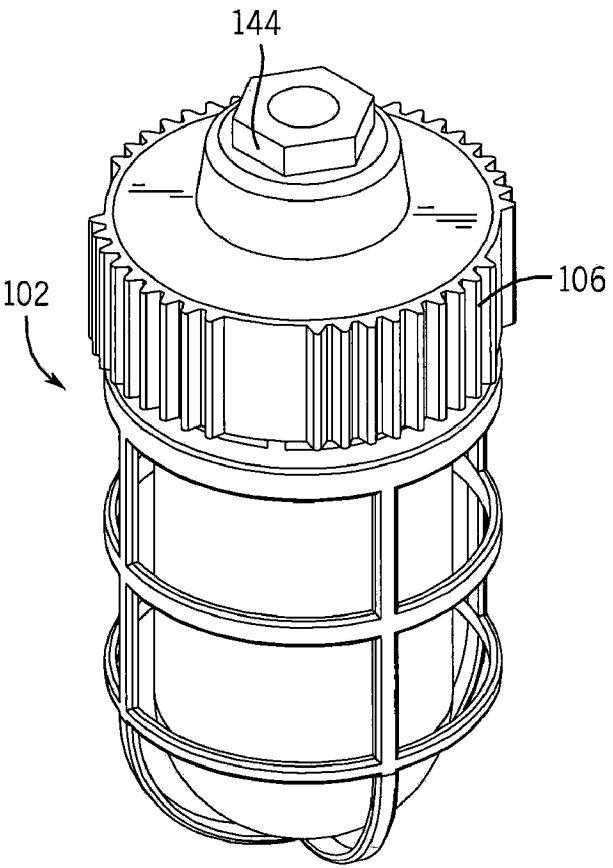
FIG. 9 is a perspective view of an exemplary light fixture utilizing the light source module and a pendant mount extension.

Referring to FIGS. 9 and 10, in at least some embodiments, the light fixture 102 can be modified to accommodate various mounting applications. For example, referring to FIG. 9, the light fixture 102 is depicted with an extension 144 secured to the light source module 106 to facilitate a pendant mount application. In FIG. 10, the light fixture 102 is depicted with an angled extension 146 secured between the light source module 106 and the mounting base 104 to facilitate a wall mount application. Further, one or more of any of the aforementioned components can be manufactured using one or more of a plurality of currently known and later developed materials, such as polymer, brass, aluminum, etc.

It is specifically intended that the present invention not be limited to the embodiments and illustrations contained herein, but include modified forms of those embodiments including portions of the embodiments and combinations of portions of different embodiments as come within the scope of the following claims.

We claim:

1. A light source module comprising:

a light source for a vapor proof light fixture;

a housing having a top portion and an upper portion extending from the top portion to form a recess, wherein the light source is situated at least partially within the recess;

a first sealing material provided inside the recess to form a seal that at least partially encapsulates the light source, wherein the seal is configured to abut a rim portion of a globe rotatably securable to the housing, to substantially prevent exposing an interior space of the globe to environmental elements outside the globe, when the globe is installed.

2. The light source module of claim 1, wherein the light source is a solid-state device.

3. The light source module of claim 1, wherein the light source is a semiconductor-based light source.

4. The light source module of claim 1, wherein the light source includes at least one light emitting diode (LED).

5. The light source module of claim 1, wherein the first sealing material is optically clear.

6. The light source module of claim 1, wherein the first sealing material is translucent.

7. The light source module of claim 1, wherein the first sealing material remains flexible after curing.

8. The light source module of claim 1, wherein the first sealing material and the top portion fully encapsulate the light source.

9. The light source module of claim 1, wherein the first sealing material provides a sealing surface opposite the top portion.

10. The light source module of claim 1, wherein the first sealing material is applied in a liquid form and subsequently cures to form a semi-solid material.

11. The light source module of claim 1, wherein the housing further comprises a bottom portion forming a base chamber for receiving a driver circuit.

12. The light source module of claim 11, further comprising a second sealing material provided inside the base chamber that at least partially encapsulates the driver circuit.

13. The light source module of claim 12, wherein the driver circuit is an LED driver circuit.

14. The light source module of claim 11, further comprising a fastening mechanism for securing the bottom portion to the mounting base of a light fixture.

15. The light source module of claim 13, wherein the bottom portion further comprises one or more protrusions for dissipating heat from the LED driver circuit.

16. A light fixture comprising:

a light source module that includes:

a housing having a top portion for receiving a solid-state light source thereon and an upper portion extending from the top portion to form a recess; and a first sealing material provided inside the recess to form a seal that at least partially encapsulates the light source;

a mounting base secured to the light source module and having a bottom portion that is configured for mounting to a surface; and a substantially cylindrical globe positionable over the top portion and securable to the upper portion of the housing, the globe having a rim portion that is configured to abut the seal along a perimeter of the rim portion to substantially prevent the intrusion of external environmental elements into an interior space of the globe.

17. A method comprising:

providing a light source for a vapor proof light fixture;

providing a housing; the housing having a top portion and an upper portion extending from the top portion to form a recess, wherein a light source is situated at least partially within the recess;

encapsulating the light source at least partially inside the recess with a first sealing material to form a seal that limits the exposure of the light source to environmental elements; and rotatably securing a globe to the housing in a direct sealing engagement with the seal, to substantially prevent exposing an interior space of the globe to environmental elements outside the globe chamber.

18. The method of claim 17, further comprising:

providing a driver circuit for the light source; and encapsulating the driver circuit at least partially inside the housing section with a second sealing material to substantially prevent exposing the driver circuit to environmental elements.

19. A light source module comprising:

an LED light source for a vapor proof light fixture;

a housing having a top portion and an upper portion extending from the top portion to form a recess, wherein the light source is situated at least partially within the recess;

a transparent first sealing material provided inside the recess to form a flexible seal that at least partially encapsulates the light source, wherein the first sealing material is configured to provide a direct sealing exposed surface opposite the top portion;

wherein the housing further includes a base chamber for receiving an LED driver circuit and a second sealing material provided inside the base chamber that at least partially encapsulates the LED driver circuit; and securing a globe to the housing in a direct sealing engagement with the seal, to substantially prevent exposing an interior space of the globe to environmental elements outside the interior space of the globe.

* * * * *